US005743803A

United States Patent [19]

Jordan et al.

[11] Patent Number: 5,743,803

[45] Date of Patent: Apr. 28, 1998

[54] CUE-STICK APPARATUS

[76] Inventors: Frank Jordan, 277 Redfish La., Boise, Id. 83706; Mike Givens, 227 Silver City Dr., Boise, Id. 83713

[21] Appl. No.: 571,600

[22] Filed: Dec. 13, 1995

[51] Int. Cl.[6] ..... A63D 15/08

[52] U.S. Cl. ..... 473/48

[58] Field of Search ..... 473/45–49

[56] References Cited

U.S. PATENT DOCUMENTS

| | | | |
|---|---|---|---|
| 364,680 | 6/1887 | Sherwood | 473/47 |
| 637,877 | 11/1899 | Lehmann | 473/45 |
| 861,158 | 7/1907 | Bucknum | 473/47 |
| 1,182,530 | 5/1916 | Doane | 473/45 |
| 1,257,420 | 2/1918 | Straka | 473/45 |
| 1,705,353 | 3/1929 | Barrett | 473/47 |
| 2,028,291 | 1/1936 | MacPherson | 473/47 |
| 3,372,932 | 3/1968 | Molis | 473/47 |
| 3,447,805 | 6/1969 | Baley | 473/45 |
| 3,711,093 | 1/1973 | Evans | 473/45 |
| 3,740,034 | 6/1973 | Scroggins | 473/48 |
| 3,858,882 | 1/1975 | Fox et al. | 273/69 |
| 4,718,671 | 1/1988 | Desmond et al. | 273/68 |
| 4,907,799 | 3/1990 | Danner et al. | 273/23 |
| 4,949,964 | 8/1990 | Jolly | 273/68 |

FOREIGN PATENT DOCUMENTS

| | | | |
|---|---|---|---|
| 736959 | 12/1932 | France | 473/47 |
| 2180458 | 4/1987 | United Kingdom | 473/48 |

OTHER PUBLICATIONS

Advertisement in Pool and Billiard Magazine, Sep. 1995 for "Buddy Hall Cue Guide," p. 22.

*Primary Examiner*—Theatrice Brown

*Attorney, Agent, or Firm*—Ken J. Pedersen; Barbara S. Pedersen

[57] ABSTRACT

Various embodiments of a sliding cue for gaming tables are shown and described. Each embodiment has a front portion for being held generally stationary in the user's front hand on the table and a back portion for being held in the user's back hand and for being moved forward and backward relative to the front portion. This forward and backward relative motion allows the user to accurately aim his shot, while holding the cue tip stably and generally motionless against or near the ball. The final forward motion of the back portion results in an impact between some part of the back portion and some part of the front portion, thus transferring kinetic energy to the front portion and, thus, to the tip of the front portion, so that the tip impacts the ball and completes the shot. An air-venting or regulating system may be included to adjust the amount of cushioning of the relative movements of the front and back portion of the cue. Transferable weights may be included to adjust the weight of the front and back portions, and detachment joints may be included for switching styles or sizes of front portion or back portion.

4 Claims, 11 Drawing Sheets

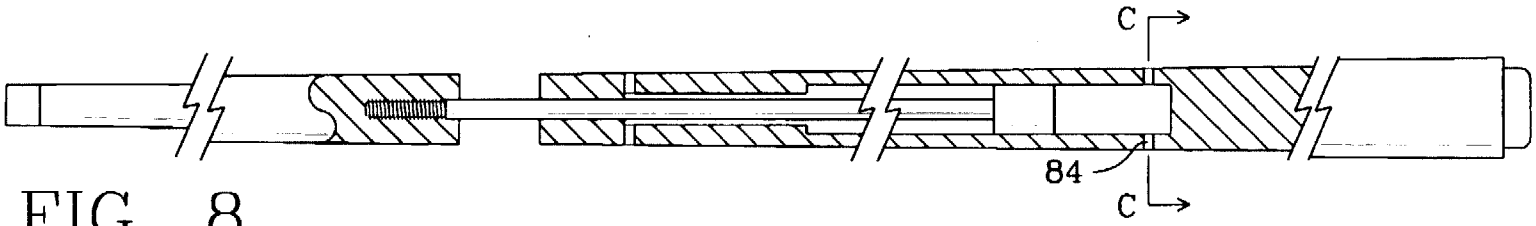
FIG. 8
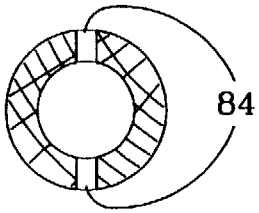
FIG. C
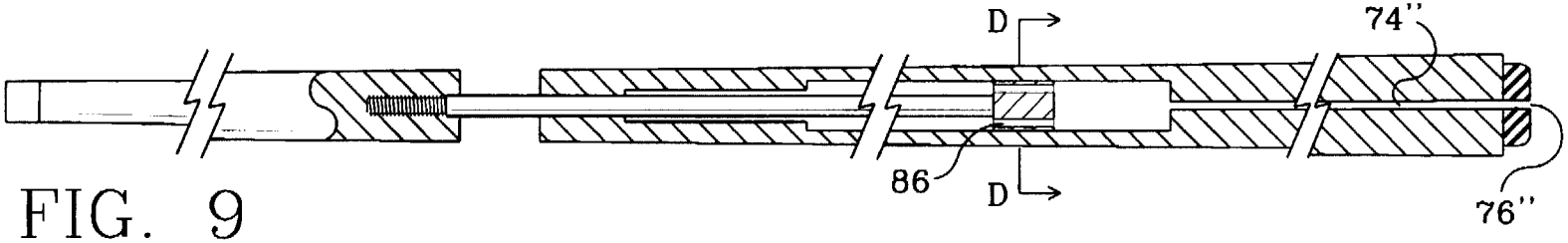
FIG. 9
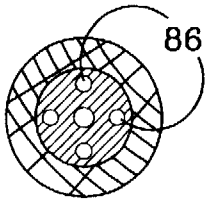
FIG. D

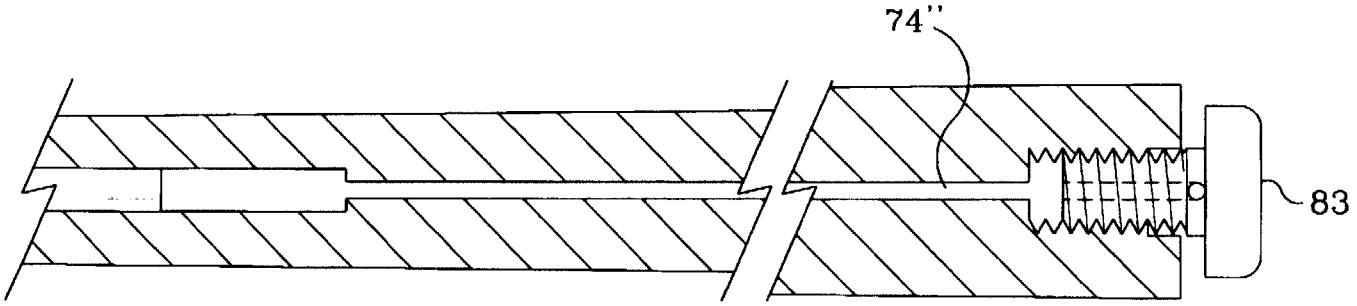
FIG. 10
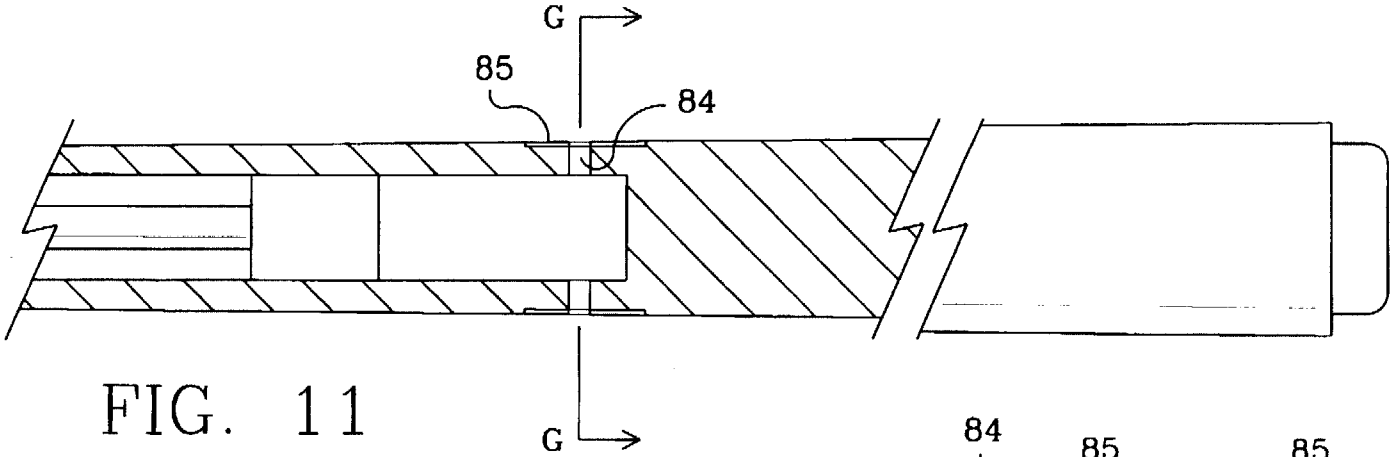
FIG. 11
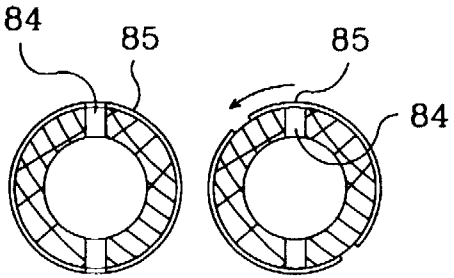
FIG. G

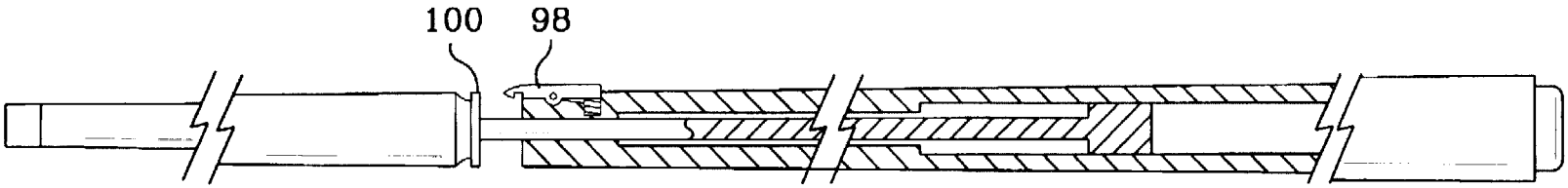
FIG. 15
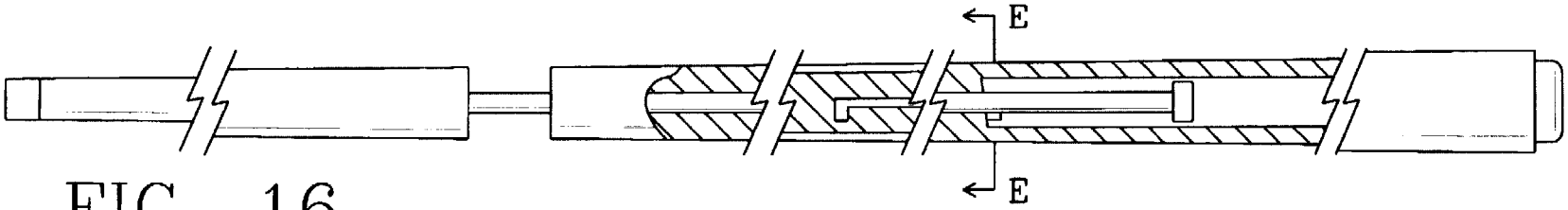
FIG. 16
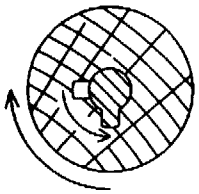
FIG. E

CUE-STICK APPARATUS

BACKGROUND OF THE INVENTION

1. Field of the Invention

This invention relates generally to pool or billiard cues. More specifically, this invention relates to cues that allow a smoother, more accurate stroke and contact with the ball by transferring kinetic energy from one portion of the cue to another.

2. Related Art

The traditional cue for use in games such as pool, billiards, snooker, etc., is an elongated, single-piece unit held in both hands, with a front hand on the shaft end of the cue and the back hand on the butt end of the cue. Typically, the user uses the back hand to slide the cue forward and backward through the front hand, which acts as a guide for the cue shaft. Thus, while the user aims his shot, he/she holds the cue tip several inches away from the ball and moves the tip several inches forward and backward, that is, toward and away from the ball, without hitting the ball. The final stroke involves a final movement of the cue forwards so that the cue tip strikes the ball, so that the ball travels in the desired direction.

Inherent in the traditional cue and aiming technique is a degree of inaccuracy and lack of smoothness, depending on the equipment, the angle and position of the shot, and the skill of the user. Throughout the aiming process, the cue shaft slides through the users hand, which sometimes causes the front hand to move or causes the cue to catch on the skin and acquire a jerking, uneven motion.

In an attempt to improve a player's performance, Fox et al. (U.S. Pat. No. 3,858,882) discloses a spring-loaded cue. In Fox et al, a rod extending back from the cue tip is pushed back into the cue housing against the bias of a spring and then locked at the desired position with locking washers. A trigger mechanism then releases the rod so that the rod "shoots" forward and hits the ball.

Several patents disclose cues or bridge sticks that have moving or sliding parts that are moved and locked in place prior to use, in order to lengthen or shorten the cue. These patents include: Desmond et al. (U.S. Pat. No. 4,718,671), Jolly (U.S. Pat. No. 4,949,964), and Danner et al. (U.S. Pat. No. 4,907,799). These extendible sticks are lengthened to fit the stature and preference of various users or to forego the use of a bridge when making shots that would otherwise require such an accessory.

Desmond et al. discloses a cue with telescopically-engaged central and butt sections permitting infinite adjustment of cue length between two end positions and a lock for securing the central and butt sections by frictional engagement at any selected cue length.

Jolly discloses a cue with an extension assembly inserted into the butt end of the stick for adjusting the cue length before use. The extension assembly has a tube having internally threaded end portions. A shaft having a threaded locking end is inserted into the tube and threadably engages a threaded first end of the tube. Rotating the handle end of the cue stick in a counter-clockwise direction disengages the tube first end from the shaft and enables extension of the handle. Once the cue is extended, rotating the handle again in a counter-clock-wise direction causes the shaft to threadably engage a threaded second tube end, thus locking the cue stick in the extended length.

Danner et al. discloses a extendible-retractable bridgestick having telescopic sections. The Danner et al. sections can be pulled apart, to lengthen the bridgestick, and then locked into place for use, by twisting each section relative to the section it engages or by friction elements.

Still, there is a need for a cue that improves accuracy and smoothness of stroke and improves the aiming process.

SUMMARY OF THE INVENTION

This invention comprises a cue stick having a front portion and a back portion and a means for allowing motion of the front and back portions relative to each other generally along the longitudinal axis of the elongated cue. The invention also comprises a stop means that limits the forward motion of the back portion relative to the front portion, allowing at least part of the momentum of the back portion to be transferred to the front portion for hitting the ball.

In use, the user holds the front portion stationary in a front hand, with the cue tip against or close to the ball, and holds the back portion in a back hand. The means for relative motion allows the user to move the back portion back and forth, that is, away from and toward the cue tip along the cue axis, for aiming of the shot. On the final forward movement, the back portion is moved forward until the stop means is reached or engaged, which stops the relative motion of the two portions and transfers at least part of the kinetic energy or momentum of the back portion to the front portion. This force, and preferably a smooth, continued force applied by the user's back hand as he/she continues into the follow-through, moves the front portion through the user's front hand to strike the ball and complete the shot, without the use of a potential energy device such as a spring or a rubber band.

Various embodiments of this invention may accomplish the objects of improving aiming and providing a smooth, accurate, powerful stroke. The invention helps to remove much of the wobble, jerking, and "give" in the aiming and striking portions of the stroke. Thus, this invention helps improve the consistency and accuracy of the stroke of both novice and expert players.

BRIEF DESCRIPTION OF THE DRAWINGS

FIG. 2A shows an embodiment featuring continuous bearing contact between the rod and bore of the back portion. FIG. 2B shows bearing contact between the rod and nose of the back portion. FIG. 2C shows bearing contact at the nose and also at the enlarged rod stop at the end of the rod.

FIGS. 6–9 are side, partially-cross-sectional views of other embodiments of the invention, showing ways of adjusting or relieving pressure in the back or front portions as the back and front portions are moved relative to each other.

FIGS. a, b, c and d are cross-sectional views of the whole cue-sticks of FIGS. 6, 7, 8 and 9, respectively, viewed from positions corresponding to lines a—a, b—b, c—c, d—d, showing veins, ports, or cavities in bearing surfaces allowing pressure equalization or adjustment.

FIGS. 10 and 11 are side, cross-sectional views of other embodiments of the cue-stick invention, each showing a back portion having regulation means for adjusting the rate of pressure change inside the cue-stick.

FIG. g is a schematic, cross-sectional view of the whole cue-stick of FIG. 11, viewed from a position corresponding to the line g—g in FIG. 11.

FIGS. 12–16 are side, partially-cross-sectional views of other embodiments of the invention, having various fasteners for locking the front and back portions of the cue in their respective positions after the front and back portions are pushed together and/or pulled apart.

FIG. e is a cross-sectional view of the whole cue-stick of FIG. 16, viewed from a position corresponding to the line e—e in FIG. 16, showing an embodiment with a keyed twist-lock with lock positions at fully-extended and fully-retracted cue positions.

FIGS. 17A–E are side views of another embodiment of the invention, including transferable weights for shifting mass between the front and back portions, for imparting greater or lesser kinetic energy with the shot.

Figure 18:
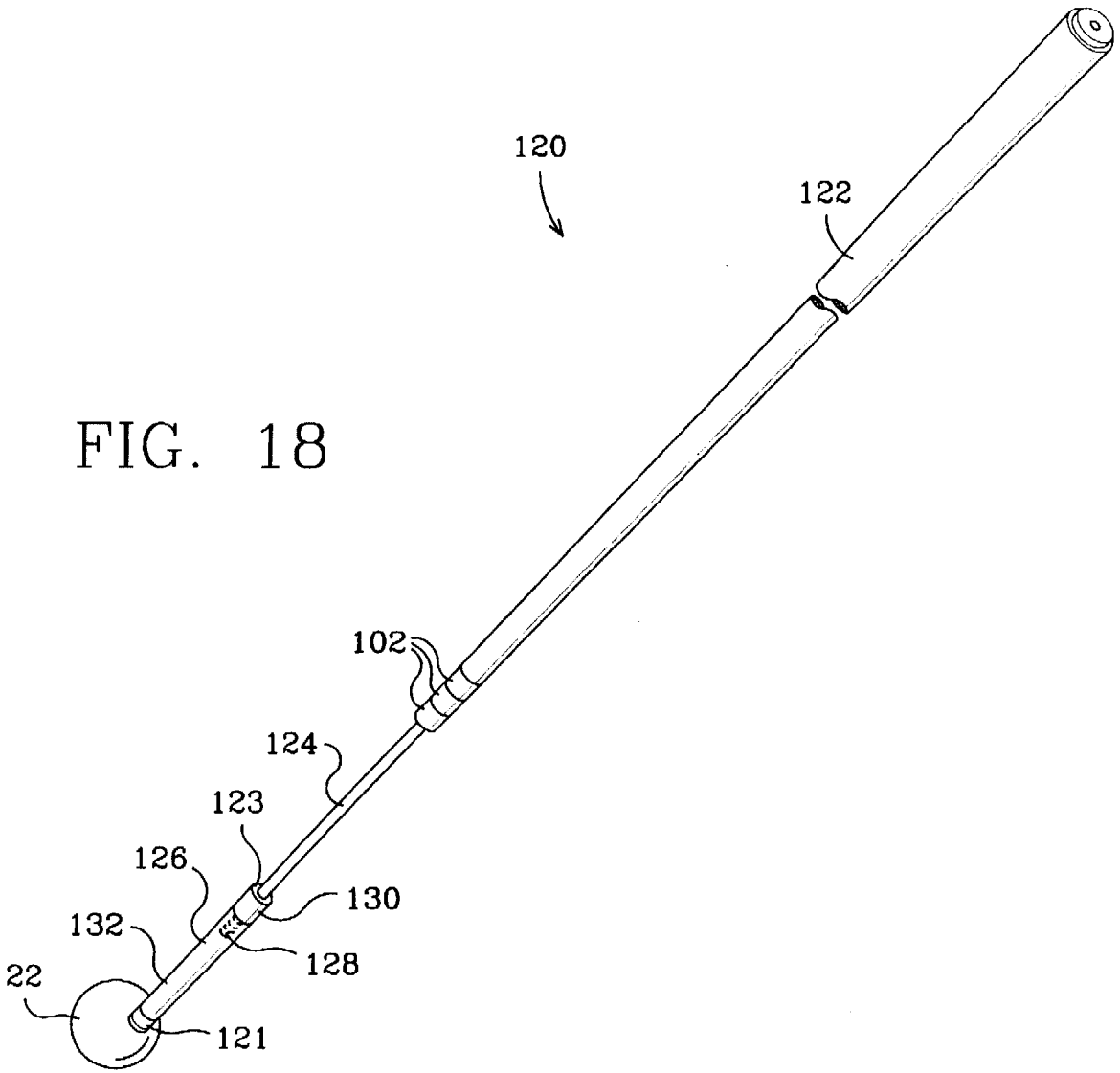

FIG. 18 is a perspective view of another embodiment of the invention, showing a jump cue adaptation of the invention.

Figure 19:
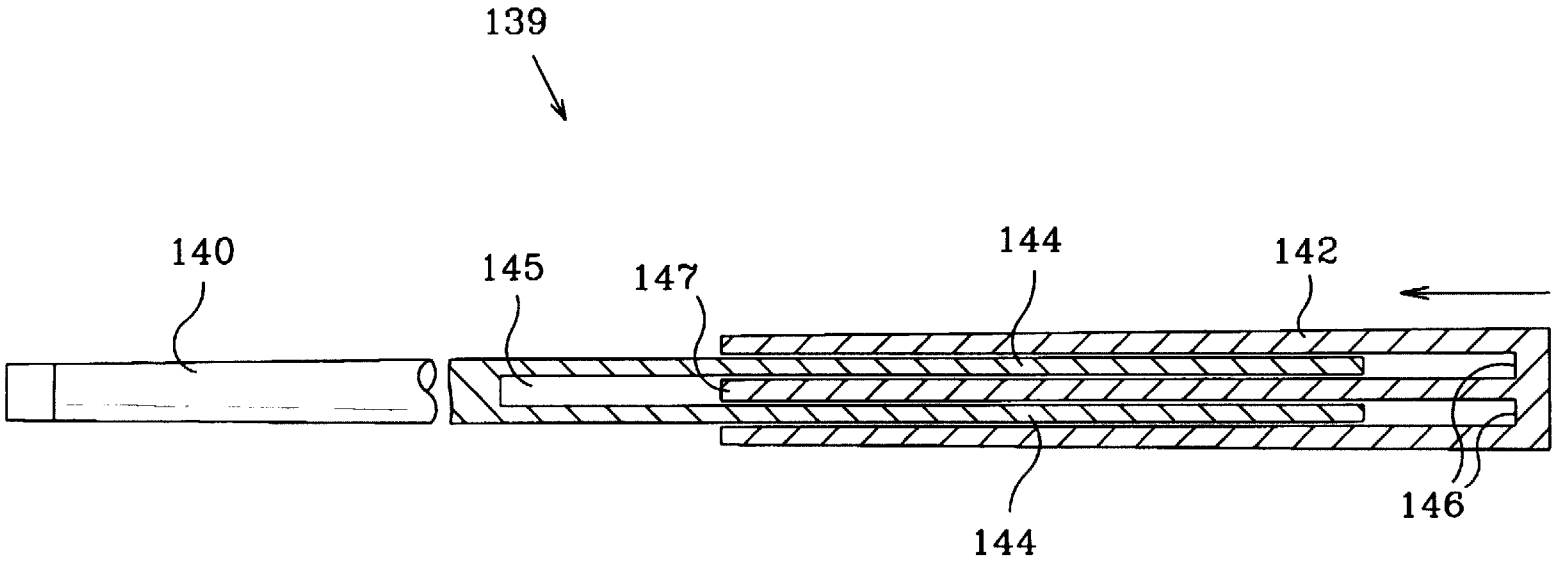

FIG. 19 is a schematic side view of another embodiment of the invention.

DESCRIPTION OF THE PREFERRED EMBODIMENTS

Figure 1A:
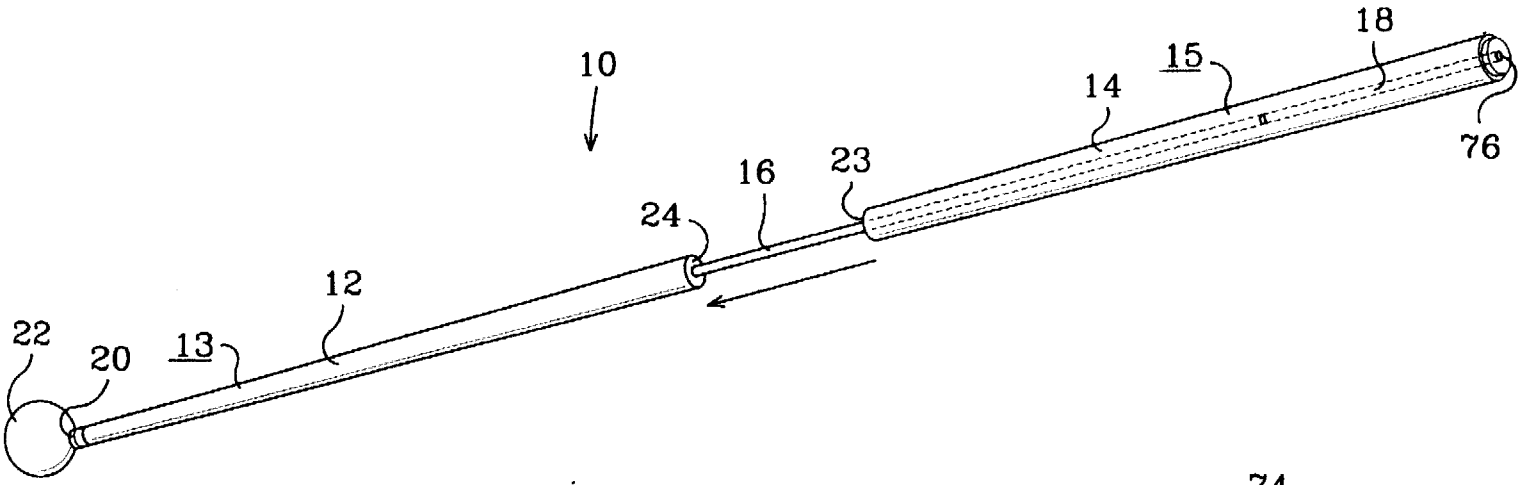
FIG. 1A is a perspective view of one embodiment of the cue-stick invention, shown with the back portion extended and the front portion tip near the ball.
Figure 1B:
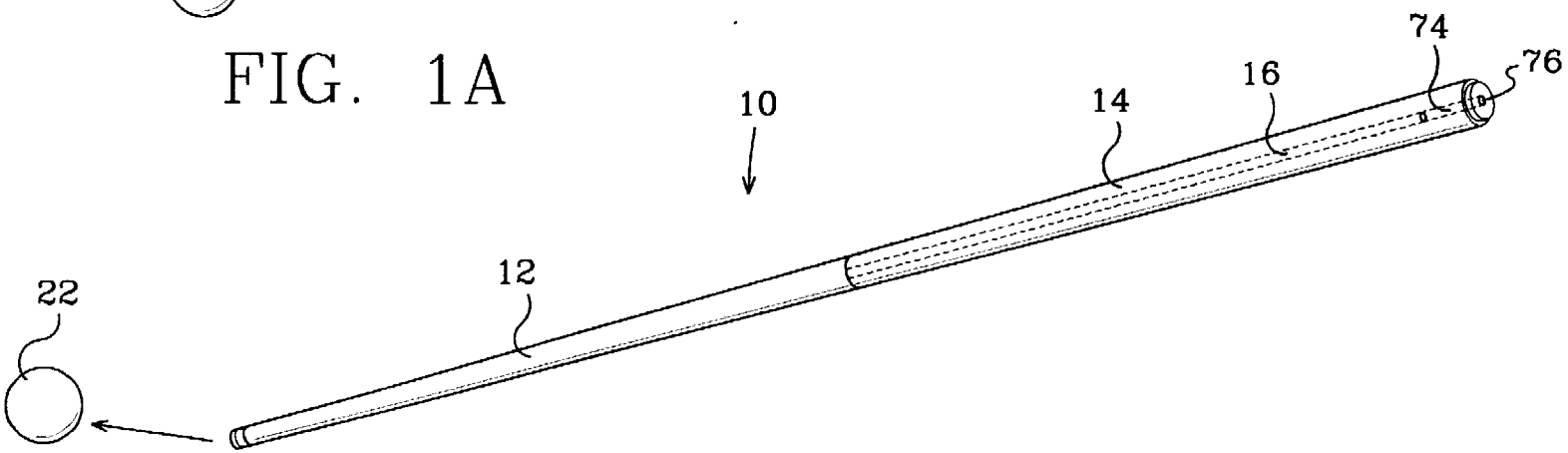
FIG. 1B is a perspective view of the embodiment of FIG. 1A, shown after the back portion has been pushed forward to abut against the front portion, thus, forcing the front portion to strike the ball.

Referring to the Figures, there are shown various, but not the only, embodiments of the invented cue. As shown in FIGS. 1A and 1B, the cue 10 comprises a front portion 12, having an outer surface 13 typically held by the user's front hand, and a back portion 14, having an outer surface 15 typically held by the user's back hand. In this cue embodiment 10, the rod 16 is a fixedly-connected or integral part of the front portion 12 and slides inside a bore 18 in the back portion 14. The front and back portions 12, 14 move relative to each other along the cue's longitudinal axis, with preferably the front portion 12 being held stationary near the gaming table surface, with the tip 20 near or against the ball 22. The user may slide the back portion 14 back and forth while aiming and then push the back portion 14 forward a final time to hit the front portion 12 and complete the shot. Thus, the cue 10 acts in a plunger-like manner, with the rod 16 and bore 18 acting as guides keeping the front and back portions 12, 14 straight along the cue axis as they extend and retract.

When pushed forward the final time, the back portion 14 impacts the front portion 12, with the nose front surface 23 hitting the tail surface 24. The impact of the back portion 14 on the front portion 12 imparts kinetic energy to the front portion 12, causing the front portion 12 to strike the ball 22 in a controlled, stable, and smooth manner, as illustrated in FIG. 1B. Preferably, the force on the ball 22 comprises the component of force from the impact of the back portion against the front portion 12 and a component of force supplied after the impact by the back hand as the user continues the stroke during contact with the ball impact and the follow-through.

Various designs may be used to provide the relative motion means and the stop means that stops relative motion between the front and back portions and that transfers energy from the back portion to the front portion of the cue.

Figure 2A:
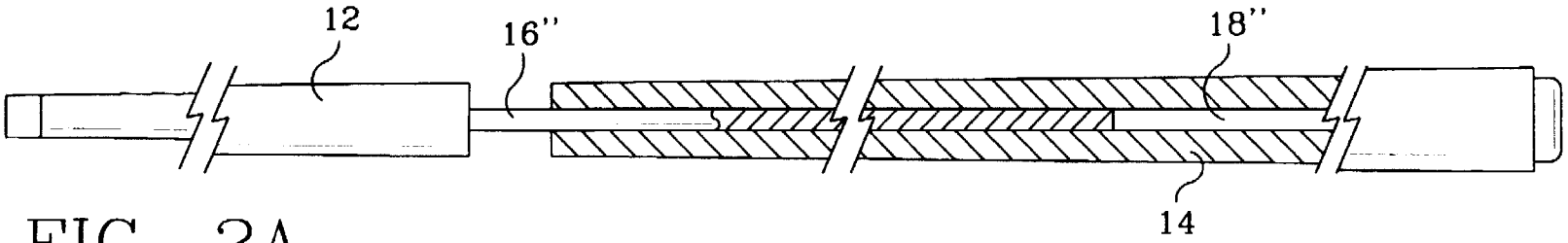
FIGS. 2A–C are side, partially-cross-sectional views showing three alternative embodiments of the internals of the embodiment of FIG. 1A, in which the back portion slides on a rod which is an extension of the front portion, and in which the front end or "nose" of the back portion impacts the back end or "tail" of the front portion.
Figure 2B:
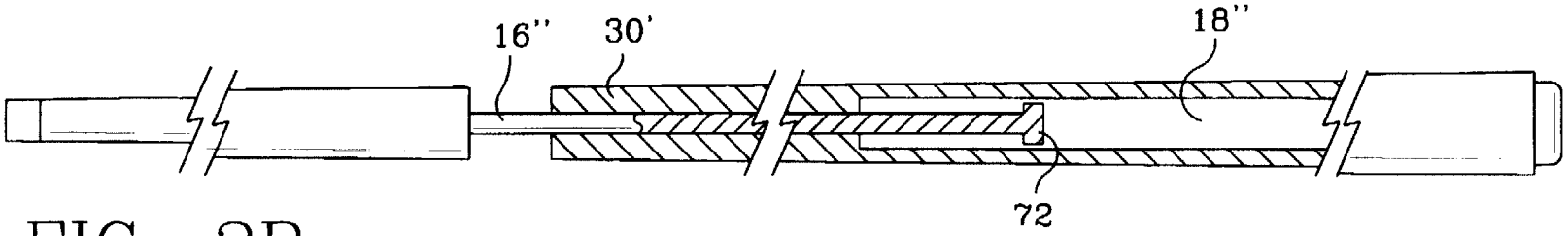
Figure 2C:
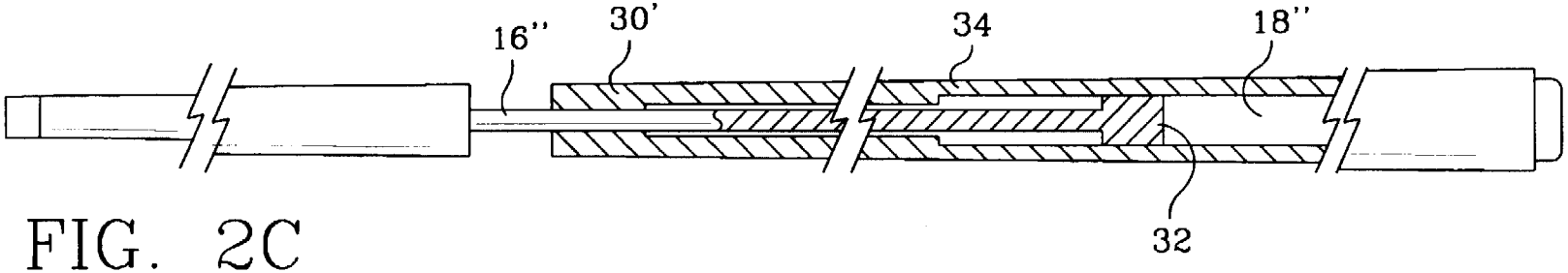
Figure 4:
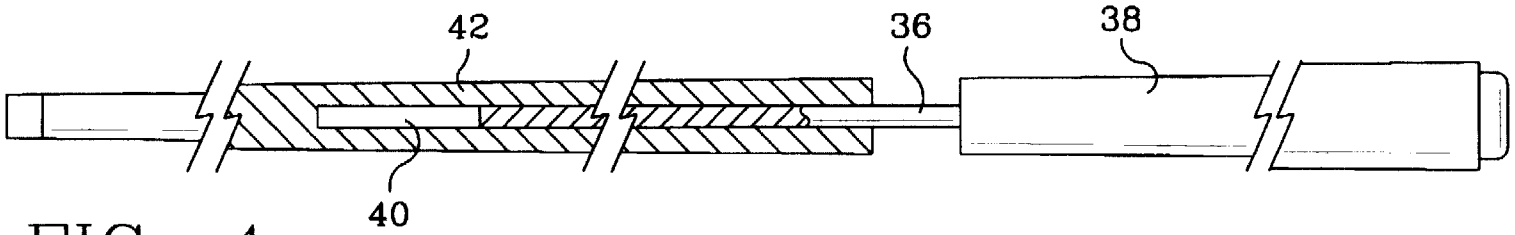
FIG. 4 is a side, partially-cross-sectional view of another embodiment of the invention, wherein the rod is an extension from the back portion and slides in a bore in the front portion of the cue.
Figure 5:
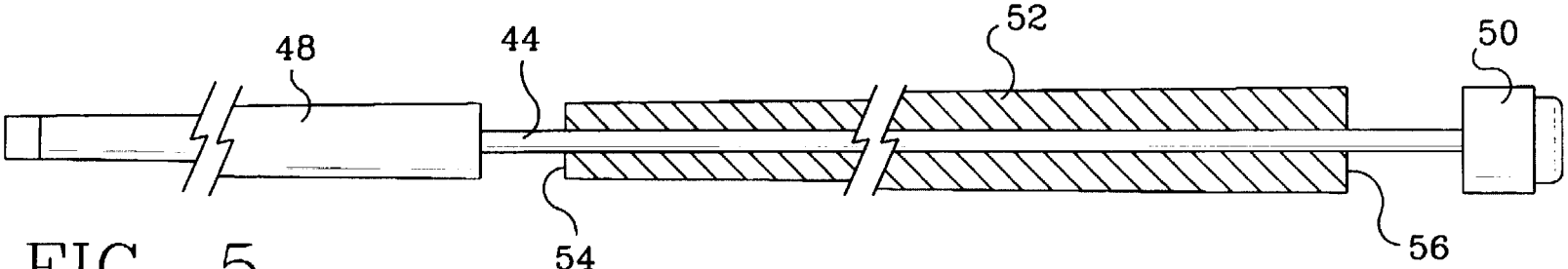
FIG. 5 is a side, partially-cross-sectional view of another embodiment of the invention, wherein a rod is a part of the front portion, slidably extending through and out of a back portion and ending with a cap.
Figure 6:
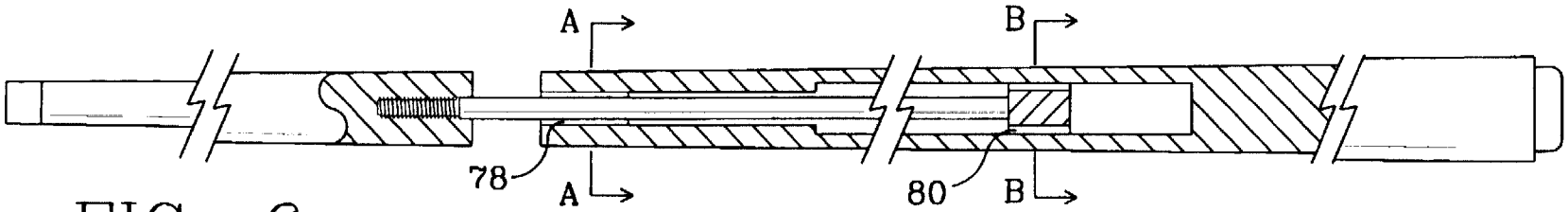

Preferably, the front and back portions are slidably connected to provide the relative motion means. The sliding surfaces may be designed with various types and locations of bearings and bearing surfaces, which may include Teflon™ or Delrin™ sleeves, linear slide bearings, or roller bearings. For example, as shown in FIGS. 2A–C, the bearing contact may be between a substantial portion of the length of the rod 16 and the bore 18 (FIG. 2A), between the rod 16' and the bore 18' in the nose region 30 (FIG. 2B), or between the rod 16" and the bore 18" in the nose region 30' and between a rod stop 32 and the bore 18" in the middle region 34 (FIG. 2C). Alternatively, the bearing contact may also be between a rod 36 that is an integral or fixedly-connected part of the back portion 38 and that slides inside a bore 40 in the front portion 42, as shown in FIG. 4. Alternatively, as shown in FIG. 5, a rod 44, fixed at one end to the front portion 48 and at the other end to a cap 50, may slide through a back portion 52 with an opening in its nose front surface 54 and its back end surface 56.

Figure 3:
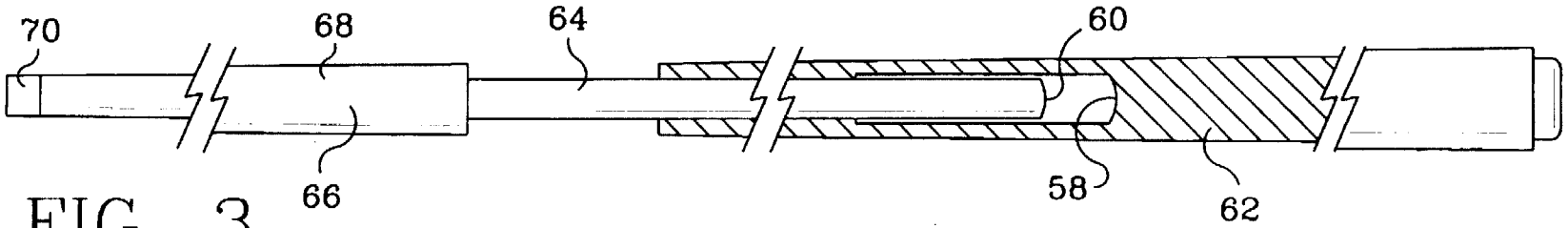
FIG. 3 is a side, partially-cross-sectional view of another embodiment of the invention, wherein the back portion slides on a rod which impacts at the end of the bore to create the stop means.

Various stop means may be employed, as showed in FIGS. 2–5. The tail surface of the front portion and nose front surface may impact and abut, stopping relative motion and forcing the front portion against the ball (FIGS. 2A–C, 4, and 5). Thus, the tail surface and nose front surface are abutment surfaces that lie in planes generally perpendicular to the cue axis. Alternatively, as shown in FIG. 3, the inside end surface 58 of the bore of the back portion impacts the rod end 60, thus stopping relative motion and transferring motion from the back portion 62 to the rod 64 of the front portion 66 and, thus to the middle region 68 of the front portion 66 and to the tip 70. In the FIG. 3 embodiment, the rod end 60 and inside end surface 58 act as abutment surfaces, in that they also are generally perpendicular to the cue axis.

Other abutment surfaces may be used to stop the relative motion of the front and back cue portions. For example, part of the back portion could slide over the middle region of a front portion and abut against a raised, radial ring surrounding the cue front portion.

Various other stops may also be used in the design of the invented cue. For example, a rod stop 72, 32 at the end of the rod 16', 16' may be included as a means for limiting the backward motion of the back portion (FIGS. 2B and C), and, optionally, also as a bearing surface (FIG. 2C). In FIG. 5, the rod cap 50 acts as a means for limiting the backward motion of the back portion 52.

Figure 7:
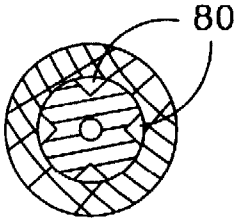
Figure 7:
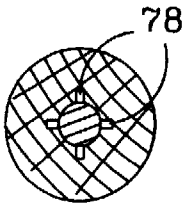
Figure 7:
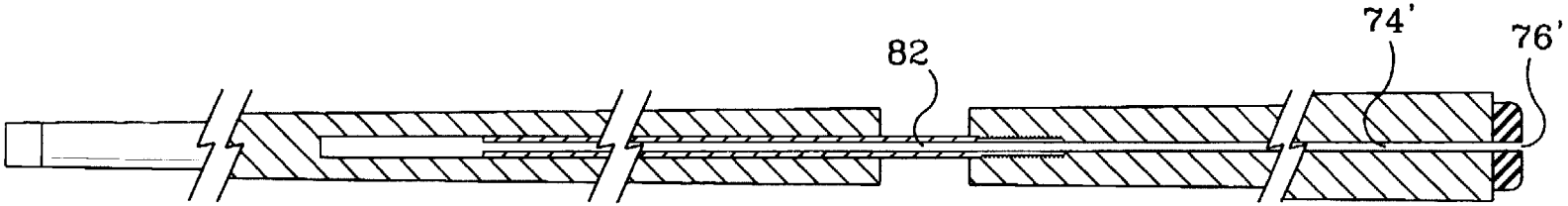

When the plunger-style rod and bore move relative to each other, pressure and/or vacuum may develop in the bore. In the preferred embodiment, pressure equalization between the bore and the outside environment is desired. Therefore, the invention preferably includes a means for adjusting pressure in the bore of either of the front or back portion, as the design may require. In some embodiments, a pressure-relief bore 74, 74', 74" extends out an end of the cue to allow air to be exhausted out and drawn in, as the rod travels toward and away from the vent hole 76, 76', 76", respectively. Such embodiments are illustrated in FIGS. 1A, 1B and 7. In addition, veins, hollow cavities, or ports may be employed for pressure equalization or management. For example, FIG. 6 and FIGS. a and b, show longitudinal veins that result in longitudinal ports 78, 80 in the bearing surfaces of the bore and the rod stop 32. FIG. 7 shows a hollow rod 82 fixed into the back portion which communicates with a pressure-relief bore 74'. FIG. 8 and FIG. c show radial ports 84 extending through the back portion that act as vent holes. FIG. 9 and FIG. d illustrate longitudinal ports 86 through a rod stop, for equalizing the regions of the bore in front of and in back of the rod stop, and a pressure-relief bore 74" extending to the vent hole 76" in the back end surface of the back portion.

Optionally, the cue pressure adjustment means may include a means for regulating the rate at which air leaves and/or enters the cue internal regions, for fine-tuning the amount of cushioning of the stroke. For example, a screw valve 83, shown in the fully-open position in FIG. 10, may be screwed inward to partially or completely restrict air flow into and out of the pressure-relief bore 74'". Alternatively, a slide valve 85 may be used to open, close, or partially close the radial ports 84 shown in FIG. 11. As illustrated in FIG. g, the slide valve 85 may be a perforated sleeve that slides to uncover (left side) and cover (right side) the ports 84. These regulation means, which restrict or open vents in the cue, control the air flow rate and optimize the cushioning of the movement of the front and back portions of the cue-stick. Optimizing the cushioning effect can add smoothness and consistency to the player's stroke and can tune a cue to the player's preferences.

Alternatively, the invention may include no separate pressure adjusting means or air flow rate regulating means. In such embodiments, the pressure in the cue internals, and therefore the cushioning effect, will be a function of how tight are the tolerances between the internals, for example, between the rod and bore. If gaps exist around the rod or rod stop, air may move through the bore around the rod or rod stop to equalize pressure in various regions of the bore and/or to equalize pressure between the bore and the outside environment. This type of pressure control is inherent in the design of the cue and does not allow for changing the cushioning effect for different circumstances or players.

Figure 12:
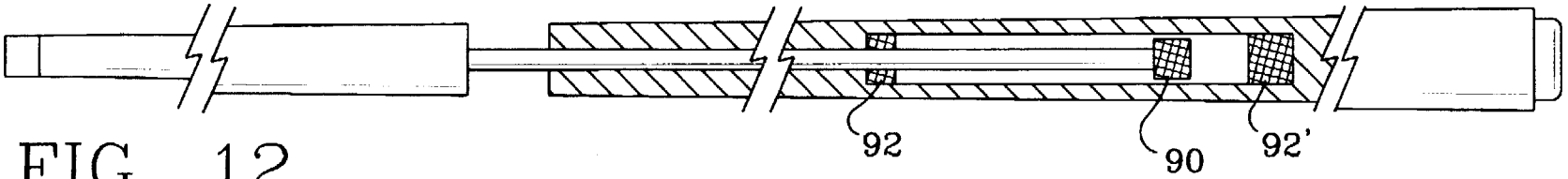
Figure 13:
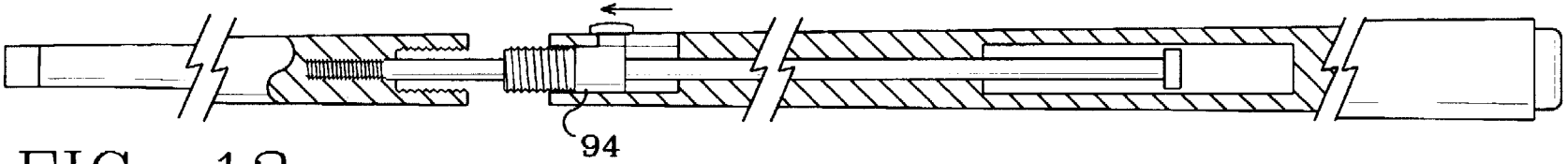
Figure 14:
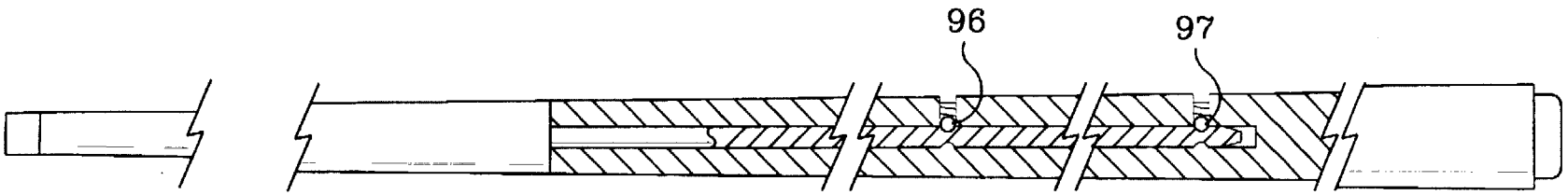

Optionally, various fasteners, latches or locks may be used for securing the front and back portions of the cue after the shot is made and/or while the user is waiting for the next shot or transporting the cue. The fastening means may be used to hold the cue only either in the fully-retracted "closed" position, in the fully-extended "open" position, or both. Fastening means are shown in FIGS. 12–16. FIG. 12 shows a magnetic rod stop 90 which is held at either end of the bore by magnetic disks 92, 92' at both ends of the bore. In FIG. 13, a threaded insert 94 may be pushed out from the nose of the back portion and screwed into the front portion. FIG. 14 shows a latch system with spring-loaded balls 96, 97 retractably lodging in grooves in the rod at either the fully-opened or closed positions. FIG. 15 shows a releasable hook 98 that slides over a lip 100 on the tail of the front portion when the front and back portions are pushed together. FIG. 16 and FIG. e show a keyed, twist-lock which can fasten the cue in the fully-open or fully-closed position.

Optionally, the invented cue may include a means for changing the weight of the front portion, back portion, or both. This means may be used to change the dynamics of the stroke by changing the mass of the impacting portions of the cue. Because kinetic energy and momentum are functions of mass and velocity, as is known from classical mechanics, changing the mass affects the momentum and kinetic energy of the impacting portions.

Figure 17A:
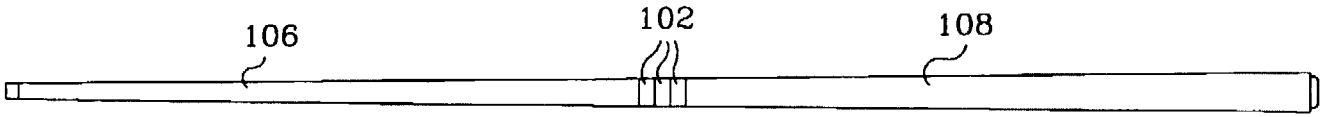
Figure 17B:
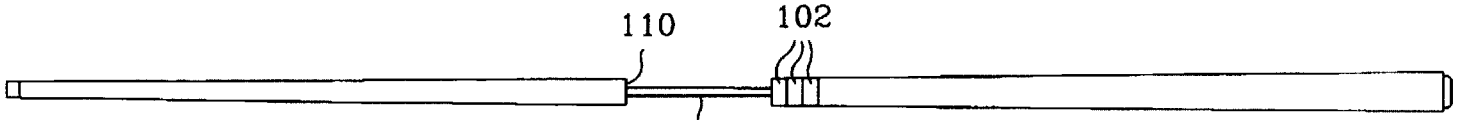
Figure 17C:
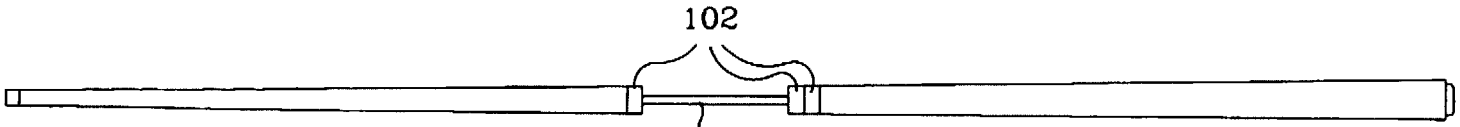
Figure 17D:
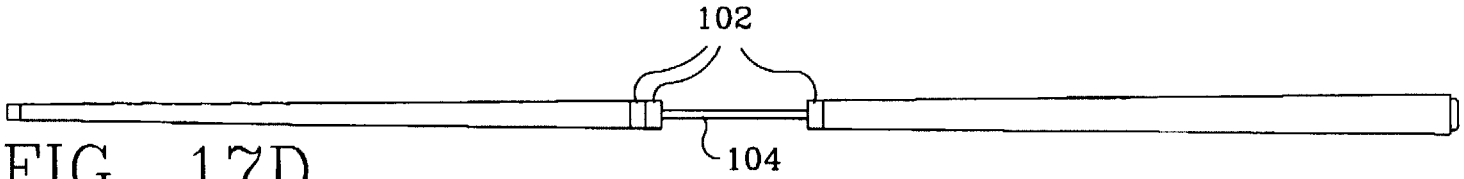
Figure 17E:
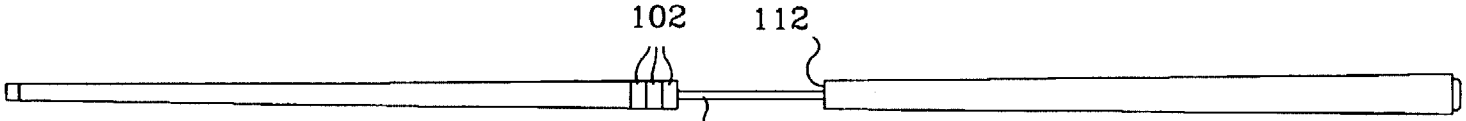

Means to change the weight of the front and back portions may comprise, for example, a transferable weight system, as shown in FIGS. 17A–E, comprising at least one weight and a means for moving the weight toward the front portion and toward the back portion. A plurality of generally cylindrical weights 102 encircle the rod 104, as shown in FIG. 17A. The weights 102 may be slid back and forth along the rod 104 and fixed in place either adjacent to the tail surface 110 of the front portion 106 (FIG. 17E) or adjacent to the nose front surface 112 of the back portion 108 (FIG. 17B). The plurality of weights 102 may be split so that part of them are associated with the front portion 106 and part of them are associated with the back portion 108 (FIGS. 17C, D). The weights 102 may be connected to each other and to the tail surface 110 and nose front surface 112 by a variety of connection means, for example, screw-together fittings, magnetic surfaces, or other disconnectable means. Thus, the weights 102 may be transferred to fine-tune the weight of the cue-stick portions and, thus, the impact of the back portion against the front portion. Moving all of the weights to the back portion, for example, would increase the mass, kinetic energy, and momentum of the back portion as it hits and forces forward the front portion of the cue. Other means for weight adjustment may be used, for example, other shapes of detachable weights connected to various regions of the cue.

Optionally, the invention may include a cue 120 designed for what is commonly known as a "jump stick". A jump stick is typically held at an extreme angle to the ball and table for putting a large amount of spin on the ball 22, causing the ball 22 to jump, hop, or curve, for example, as in a masse' stroke in billiards. The cue 120 preferably has a front portion 126 that is preferably only about 4 inches long from the tip 121 to the tail surface 123, and a back portion 122 and rod 124 similar to those in other embodiments. Preferably, the front portion 126 from tip to tail surface is less than about ⅕ the length of the back portion 122. Rod 124 may be a part of the front portion 126 and may be received in a bore in the back portion 122, as in the embodiment of FIG. 2A. Cue 120 may optionally include weights 102 for adjusting the relative weights of the front and back portions 126, 122, as described above.

Optionally, any or all embodiments of the invention may have one or more joints connecting sections of the cue together. For example, a threaded joint may be included in the front portion preferably near the rod, so that part of the front portion may be detached for storage or for switching to another length, style, or material of front portion. Alternatively, the front portion or back portion may be adapted for detachment from the cue by other means, for example, by unscrewing from the rod, detachment of the entire front portion including rod from the back portion, etc. This detachment means allows the cue to have a replaceable front portion, for example, to fit the cue alternately with the short front portion for use as a jump stick and with a regular-size front portion for use on other shots. The preferred detachment means, as shown in FIG. 18, is a joint 127 comprising a threaded shaft 128 near the tail surface 123 which is received in a threaded bore to join a first section 130 and a second section 132 together.

An alternative embodiment 139 of the invention, shown in FIG. 19 allows a conventional cue to be adapted to include a relative motion means and stop means for transfer of kinetic energy. For example, the front portion 140 is the entire conventional cue and the back portion is a generally cylindrical handle 142 that slides over the butt end 144 of the cue. The handle 142 has a rod 147 which slides into a bore 145 cut into the butt end 144. Or, alternatively, the handle may be made without a rod and without requiring a bore 145, so that it is a sleeve that slides over the outside of the butt end 144. The handle preferably extends far enough forward on the cue that the user may use his/her back hand to move the handle forward and backward during aiming and then impact the inner surface 146 against the butt end 144 to impart the kinetic energy to the front portion 140 to complete the shot. Bearings and/or bearing surfaces may be included on the interior or exterior of the butt end 144.

Although this invention has been described above with reference to particular means, materials and embodiments, it is to be understood that the invention is not limited to these disclosed particulars, but extends instead to all equivalents within the scope of the following claims.

I claim:

1. A cue for impacting a ball on a gaming table, the cue having a longitudinal cue axis and consisting of:

an elongated front portion having an outer surface for gripping by a user, the front portion having a cue tip for impacting the ball;

an elongated back portion having an outer surface for gripping by a user, the back portion having a bore running parallel to the longitudinal cue axis;

a rod extending from said front portion, parallel to the longitudinal cue axis, and slidably received in the bore;

wherein said back portion is movable, for aiming, forward toward the front portion to retract the cue and backward away from the front portion to extend the cue; and a stop means for halting the forward motion of the back portion relative to the front portion by the back portion impacting the front portion to transfer energy from the back portion to the front portion for impacting the ball with the cue tip;

wherein said cue is without potential energy means; and wherein said cue is without fastening means for securing the back portion to the front portion in positions other than a fully-retracted, closed position or a fully-extended, open position, or both fully-retracted and fully-extended positions.

2. A cue as in claim 1, wherein the front portion has a ledge surface generally perpendicular to the cue axis and the back portion has a ledge surface generally perpendicular to the cue axis, and the stop means comprises said front portion ledge and said back portion ledge being adapted to abut when the back portion is moved forward to a fully-retracted position.

3. A cue as in claim 1, wherein the rod comprises a stop means for limiting the backward movement of the back portion relative to the front portion.

4. A cue as in claim 1, wherein the back portion comprises a pressure-relief bore for controlling air flow into and out of the back portion bore.

* * * * *